United States Patent [19]

Lang et al.

[11] Patent Number: 4,799,031

[45] Date of Patent: Jan. 17, 1989

[54] WAVEGUIDE DEVICE FOR PRODUCING ABSORPTION OR ATTENUATION

[75] Inventors: Manfred Lang, Taufkirchen; Walter Höppler, Munich, both of Fed. Rep. of Germany

[73] Assignee: Spinner GmbH, Elektrotechnische Fabrik, Munich, Fed. Rep. of Germany

[21] Appl. No.: 126,841

[22] Filed: Nov. 30, 1987

[30] Foreign Application Priority Data

Dec. 2, 1986 [DE] Fed. Rep. of Germany ..... 3641086

[51] Int. Cl.[4] ..... H01P 1/22; H01P 1/26

[52] U.S. Cl. ..... 333/22 R; 333/22 F; 333/81 B

[58] Field of Search ..... 333/22 F, 22 R, 81 B, 333/113, 114

[56] References Cited

U.S. PATENT DOCUMENTS

| | | | |
|---|---|---|---|
| 2,512,191 | 6/1950 | Wolf | 333/22 R X |
| 2,779,001 | 1/1957 | Records | 333/22 R X |
| 2,846,647 | 8/1958 | MacPherson | 333/22 FX |
| 3,030,592 | 4/1962 | Lamb et al. | 333/22 F |
| 3,509,496 | 4/1970 | Griffin et al. | 333/22 R |
| 3,940,719 | 2/1976 | Booth | 333/22 F |
| 4,638,268 | 1/1987 | Watanabe et al. | 333/22 F |

FOREIGN PATENT DOCUMENTS

| | | | |
|---|---|---|---|
| 233902 | 11/1985 | Japan | 333/81 B |

OTHER PUBLICATIONS

Edwards, N. E. et al; "Mircrowave Harmonic Power Absorber"; *RCA Technical Notes*; RCA TN No. 505; Mar. 1962.

Larson W.; "Inline Waveguide Attenuator"; Reprint of *IEEE Transactions on Microwave Theory and Techniques*; vol. MTT-12, No. 3; May 1964.

*Primary Examiner*—Eugene R. LaRoche
*Assistant Examiner*—Benny Lee
*Attorney, Agent, or Firm*—Henry M. Feiereisen

[57] ABSTRACT

A waveguide device for producing absorption or attenuation includes a waveguide section which is provided with an external absorber material. For allowing a transfer of the high-frequency power into the absorber material, the wave section is provided with coupling apertures via which the absorber material is in connection with the interior of the waveguide section.

18 Claims, 4 Drawing Sheets

WAVEGUIDE DEVICE FOR PRODUCING ABSORPTION OR ATTENUATION

FIELD OF THE INVENTION

The present invention refers to a waveguide device for producing absorption or attenuation, and in particular to a waveguide absorber or waveguide attenuator which includes a waveguide section provided with absorber material which is penetrated by a wave propagating in the waveguide section.

In general, a waveguide absorber is closed on one end and is provided at its other end with a connecting flange for making attachment to e.g. a connecting flange of a further waveguide. The difference to a waveguide attenuator resides merely in the fact that the latter is provided with a connecting flange at both its opposing axial ends and that the wave is not completely absorbed but only attenuated to a predetermined degree. It should be noted that when using the term "waveguide absorber" in the following description, this should be interpreted to include a waveguide attenuator as well.

There are known waveguide absorbers for small powers which include a waveguide section provided at the closed end thereof with a solid absorber material in form of a foil or wedge-shaped block. For use as absorber material layers of hard coal, if necessary placed on suitable carriers, ferrites or dissipative dielectrics are proposed For power absorbers, however, the use of a liquid absorber material, usually water has been proposed. Various structures for such power absorbers are known e.g. a pipe which traverses the waveguide section slantingly with regard to the waveguide axis and is made of insulating material, an insulating plate extending also slantingly in the waveguide section relative to the waveguide axis to separate a space through which water may flow, and finally a $\lambda/4$-transformer of insulating material which separates a space through which water may flow.

Waveguide absorbers with solid absorber material have the drawback that their use is restricted only for smaller powers because it is difficult to carry away the dissipated power toward the outside. On the other hand, waveguide absorbers with liquid absorber material have the drawback that a good matching, i.e. a small reflection is achieved only over a small band width.

SUMMARY OF THE INVENTION

It is thus an object of the present invention to provide an improved waveguide device for producing absorption or attenuation obviating the afore-stated drawbacks.

This object and others which will become apparent hereinafter are attained in accordance with the present invention by providing a waveguide section covered externally with absorbing material which is coupled with the interior of the waveguide section via a plurality of coupling apertures in the waveguide section so as to allow a wave propagating in the waveguide section to penetrate the absorbing material.

As experienced in known waveguide absorbers, an excessive power concentration was obtained especially at high frequencies when the waveguides are of small cross sections. The provision of a waveguide device in accordance with the present invention prevents such an excessive power concentration through a suitable dimensioning of the size and of the spacing between the coupling apertures regardless whether a solid or a liquid absorber material is used. Consequently, the power to be dissipated can be linearly drawn from the waveguide section over a preselected axial length so that the absorber material is uniformly heated over its length. Since the absorber material is arranged outside the waveguide section, the provision of suitable cooling means is considerably facilitated.

The coupling apertures can be shaped as longitudinal slots, transverse slots or oblique slots and their dimension and orientation are dependent on the type of wave propagating in the waveguide and the cross section of the waveguide as well as on the desired bandwidth.

Although it is usually sufficient to arrange the absorber material in the area of the coupling apertures, it may be suitable especially for power absorbers to surround the waveguide section completely with absorber material in circumferential direction in order to achieve a more uniform temperature distribution and an improved cooling effect.

According to a preferred embodiment of a power absorber, water is used as absorber material which is contained in a space surrounding the waveguide section by suitably enclosing the latter within a container or the like. The interior of the waveguide section is separated from the surrounding water-filled space and thus protected from penetrating water by a layer of insulating material which tightly covers at least the coupling apertures. Certainly, the waveguide section may be covered in its entirety by this layer. Preferably, the layer of insulating material is made of a dielectric as e.g. thermoplastic, polytetrafluoroethylene or quartz.

According to a further feature of the invention, the container is provided with an inlet port and outlet port and is connected to a recooling device so that the liquid absorber material may be circulated in a cooling cycle for absorbing especially high microwave powers.

When using a solid material as absorber material, like e.g. silicon carbide all suitable methods for a ducted cooling can be applied. An especially effective cooling is obtained when providing cooling channels within the absorber material for the cooling fluid.

The waveguide device in accordance with the invention is applicable as a waveguide absorber or waveguide attenuator and is suitable for absorption or attenuation by a predetermined factor of high microwave powers especially at very high frequencies (above 10 GHz) over a broad band.

BRIEF DESCRIPTION OF THE DRAWING

The above and other objects, features and advantages of the present invention will now be described in more detail with reference to the accompanying drawing in which.

DESCRIPTION OF PREFERRED EMBODIMENTS

Figure 1:
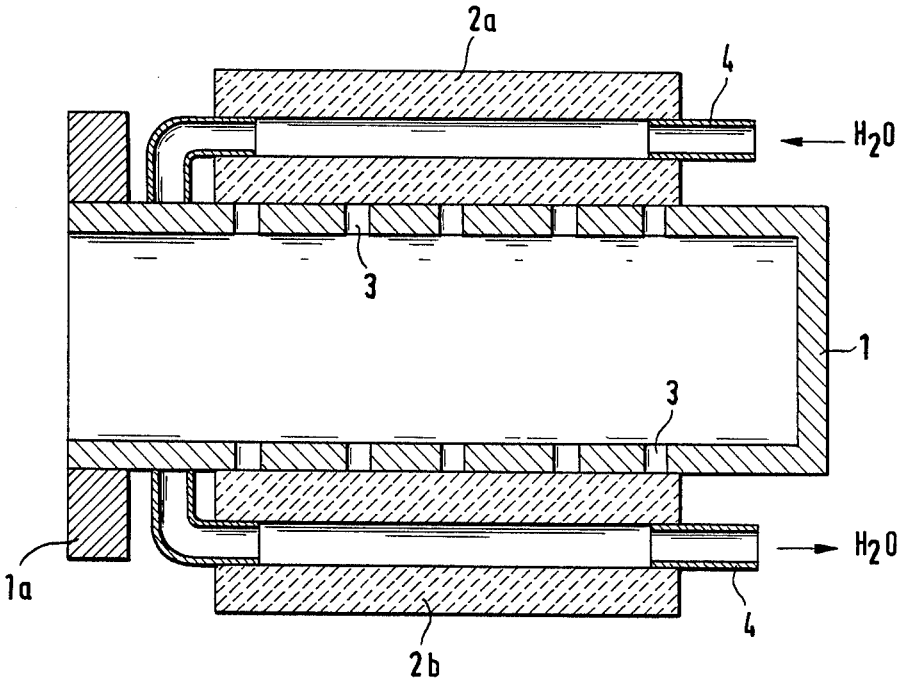
FIG. 1 is a cross sectional view of a first embodiment of a waveguide absorber in accordance with the invention and provided with solid absorber material.

Referring firstly to FIG. 1, there is shown a cross sectional view of a waveguide absorber according to the invention for decreasing the power carried by an electromagnetic wave. The waveguide absorber includes a waveguide section 1 which is closed on one axial end and provided at its other axial end with a connecting flange 1*a* for allowing attachment with a further waveguide. Extending along a major portion of its opposing walls, the waveguide section 1 is provided with external blocks 2*a*, 2*b* which are made of solid absorbing material like silicon carbide and preferably enclose the waveguide section 1 completely in circumferential direction thereof. The blocks 2*a*, 2*b* are connected with the interior of the waveguide section 1 via a plurality of spaced coupling apertures 3 which are dimensioned and spaced in such a manner that the same amount of power is transferred through the openings 3 to the blocks 2*a*, 2*b* where the power is transformed into heat.

In order to effectively dissipate the heat generated in the blocks 2*a*, 2*b*, a cooling pipe or channel 4 may be embedded in the blocks 2*a*, 2*b* for allowing water to circulate. It will be readily recognized, however, that such a water cooling system may be omitted if the absorbed powers are relatively small.

Figure 2:
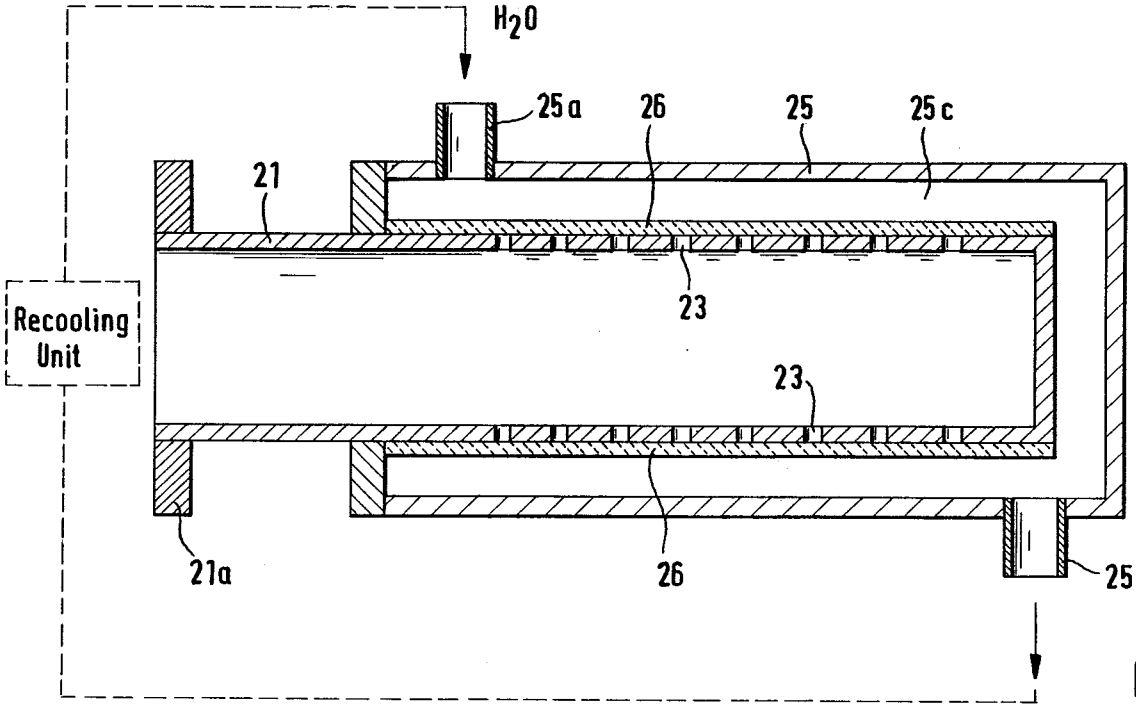
FIG. 2 is a cross sectional view of a second embodiment of a waveguide absorber in accordance with the invention and provided with liquid absorber material.

Turning now to FIG. 2, there is shown a cross sectional view of a second embodiment of an absorber in accordance with the invention which uses water as absorber material as well as cooling medium. The absorber includes a waveguide section 21 essentially of the same type as the waveguide section 1 illustrated in FIG. 1 and thus including a connecting flange 21*a* and a plurality of coupling apertures 23 spaced along the opposing walls. In contrast to the embodiment of FIG. 1, the waveguide section 21 is sealingly supported along a major part thereof in a surrounding container 25 which is of suitable dimensions to define an inner space 25*c* surrounding the waveguide section 21 and filled with water.

At a suitable location of its top side, the container 25 is provided with a water inlet port or nipple 25*a* while its bottom has a suitable water outlet port or nipple 25*b* so that water contained in the inner space 25*c* may circulate to provide an effective cooling. In order to separate the interior of the waveguide section 21 from the water-filled inner space 25*c*, the waveguide section 21 is covered along its wall sides provided with the coupling apertures by a layer 26 of suitable dielectric. It will be appreciated, however, that the layer 26 may, however, be provided only in the area of the coupling apertures 23 and thus does not necessarily enclose entirely the waveguide section 21. In addition, it should be noted that the container 25 may surround the waveguide section 21 only along the coupling apertures 23, however, the cooling effect is improved when the waveguide section 21 is completely surrounded.

The coupling apertures 23 may be of any suitable shape like boreholes or slots whereby its shape, size and location is selected in the same manner as in the embodiment of FIG. 1 which means that the power carried by an electromagnetic wave propagating in the interior of the waveguide section 21 is decreased through each aperture by the same amount while the matching over the entire usable bandwidth of the respective waveguide section is retained so that the characteristic impedance remains practically constant.

The container 25 may be of any suitable shape and size as long as the amount of water flowing through the inner space 25*c* is sufficient to dissipate the power or heat. Evidently, the water can be guided in an open or closed circulation. In the latter case, a recooling unit for the water may be interposed in the circulation as indicated by broken line in FIG. 2.

When using a circular wave guide, the shape, the size and the position of the coupling apertures depend on the polarization of the transverse electric mode $TE_{11}$ which represents the fundamental mode in the circular section. Thus, the coupling apertures are of slotted shape. Also other shapes of the coupling apertures are possible.

Figure 3:
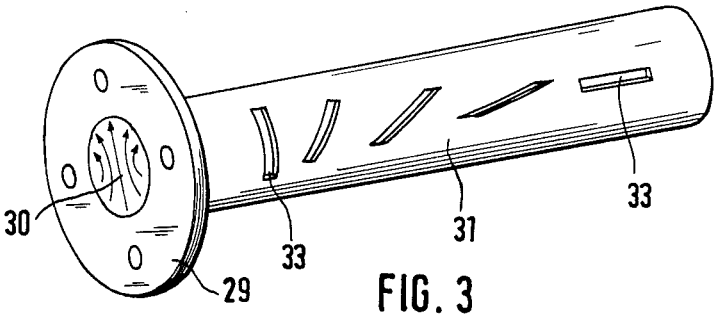
FIG. 3–5 are perspective illustrations of further embodiments of waveguide absorbers in accordance with the invention and showing various arrangements of coupling apertures.

Referring now to FIG. 3, there is shown a perspective illustration of a waveguide section 31 of round cross section which is provided with a connecting flange 29 at one end thereof. Along its axial length, the waveguide section 31 includes a plurality of spaced coupling slots 33 suitably covered externally by an absorbing material which for ease of illustration is, however, not shown. The coupling slots 33 are directed in such a manner that at a direction of polarization of the $TE_{11}$ mode as indicated by arrows 30 the transverse currents are used for coupling out the power. Since the power density of the high frequency wave decreases in direction of propagation, the coupling slots 33 extend in direction of propagation with decreasing inclination so that the coupling factor is increased in direction of propagation. Thence, the same amount of power is transferred through the coupling slots 33 to the absorbing material. In the nonlimiting example of FIG. 3, the coupling slot 33 which extends adjacent to the connecting flange 29 is essentially vertical while the coupling slot 33 arranged furthest from the flange 29 is essentially horizontal.

Figure 4:
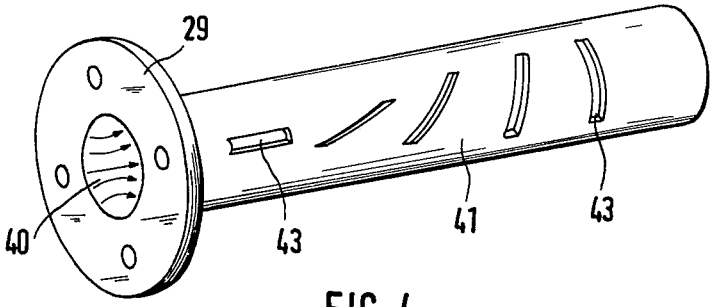

FIG. 4 shows a round waveguide section 41 which is similar to the waveguide section 31 except that the longitudinal currents are used for coupling out the power and thus, the coupling slots 43 are arranged in the polarization plane as indicated by arrows 40 and extend in propagation direction of the wave with increasing angle relative to the longitudinal axis of the waveguide section 41. In FIG. 4, the slot 43 closest to flange 29 is horizontal and the slot 43 furthest from flange 29 is vertical. For ease of illustration of the coupling slots 43 the surrounding absorber material is not shown in FIG. 4.

Figure 5:
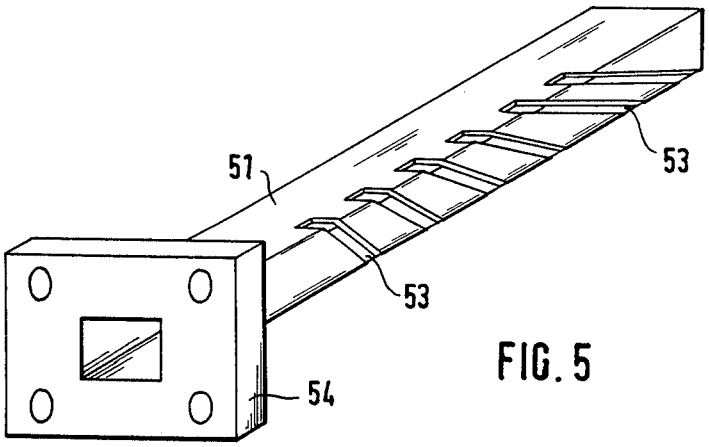

Turning now to FIG. 5, there is shown a perspective view of an absorber which includes a waveguide section 51 of rectangular cross section which is provided at one axial end with a connecting flange 54. Along its narrow sides, the waveguide section 51 is provided with coupling slots 53. Although not shown in the drawing, the coupling slots may alternatingly be provided along the broad sides or as indicated in FIG. 5 along the narrow sides and in addition along the broad sides.

Since in the transverse electric wave $TE_{10}$ which represents the fundamental wave in the rectangular cross section, currents flow at the narrow side only perpendicular to the axis of the waveguide, the coupling slots 53 are spaced with decreasing inclination relative to the waveguide axis in direction of propagation. Thus, the first coupling slot 53 in propagation direction causes the weakest coupling while the last coupling slot 53 causes the strongest coupling so that a suitable spacing of the coupling slots allows a transfer of equal amounts of power without impairing the matching.

Regardless of the arrangement of the coupling slots 53 in the waveguide section 51, an overall attenuation of about 20 dB can be attained over the entire frequency range for which the respective waveguide is applicable. For instance for the waveguide R 320 with a frequency range of 26 to 40 GHz, the measured VSWR is always below 1.04 in this frequency range.

Figure 6:
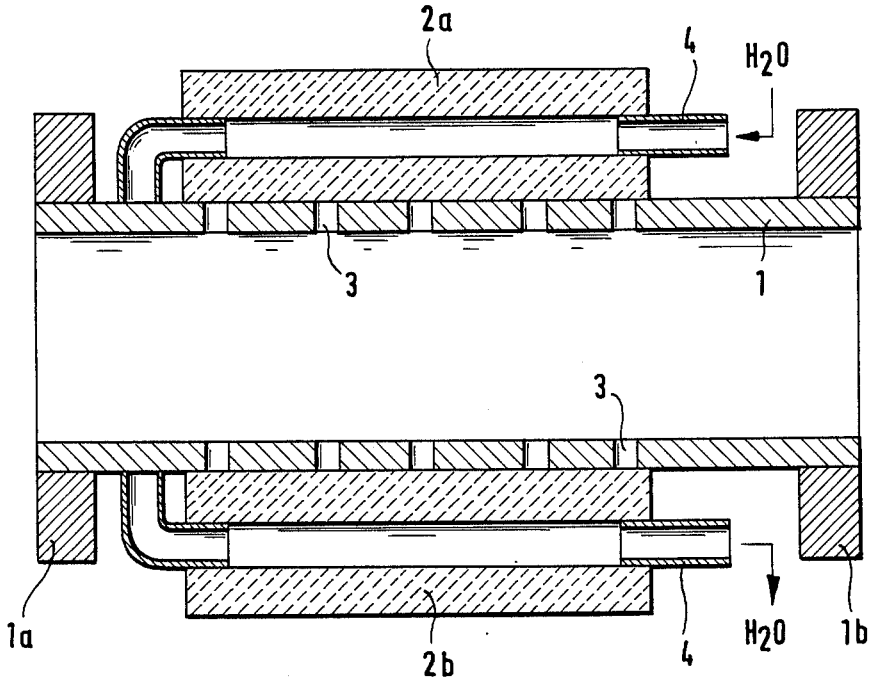
FIG. 6 is a cross sectional view of one embodiment of a waveguide attenuator in accordance with the invention.

FIG. 6 shows a cross sectional view of one embodiment of a waveguide attenuator which differs from the waveguide absorber illustrated in FIG. 1 solely in that the waveguide section 1 is not closed at its end opposing the connecting flange 1*a* but is provided there with a further connecting flange 1*b* for attachment of e.g. a further waveguide section. The coupling apertures 3 are dimensioned in such a manner that a previously defined portion of the HF-wave propagating from left to right through the waveguide section 1 is coupled out and converted to heat in the solid absorber material of the blocks 2*a*, 2*b*.

It should be noted that the absorber as shown in FIG. 2 may certainly be modified in the same manner to a waveguide attenuator. Likewise, the wave sections and coupling apertures as illustrated in FIGS. 3 to 5 may be converted in the same manner to a waveguide attenuator.

While the invention has been illustrated and described as embodied in a Waveguide Device for Producing Absorption or Attenuation, it is not intended to be limited to the details shown since various modifications and structural changes may be made without departing in any way from the spirit of the present invention.

What is claimed as new and desired to be protected by Letters Patent is set forth in the appended claims:

1. A waveguide device for producing absorption or attenuation; comprising:

a waveguide section defining an axis and having an interior; and absorbing means arranged externally along said waveguide section for absorbing or attenuating a wave propagating in said waveguide section in a direction of progation along said axis, said waveguide section being provided with a plurality of apertures for coupling said absorbing means with said interior, said apertures being spaced successively along the direction of wave propagation and being of a shape and dimension so that the wave is allowed to penetrate said absorbing means and a same amount of power is coupled out through each of said apertures.

2. A waveguide device as defined in claim 1 wherein said apertures are shaped in form of elongated slots extending in the direction of said axis.

3. A waveguide device as defined in claim 1 wherein said apertures are shaped in form of elongated slots extending transversely to said axis.

4. A waveguide device as defined in claim 1 wherein said apertures are shaped in form of elongated slots extending obliquely to said axis.

5. A waveguide device as defined in claim 1 wherein said absorbing means includes blocks of absorber material which are provided with channels for allowing a cooling medium to flow therethrough.

6. A waveguide device as defined in claim 1 wherein said absorbing means includes an absorber material completely surrounding said waveguide section.

7. A waveguide device as defined in claim 1 wherein said absorbing means includes a liquid absorber material, and further comprising means for surrounding said waveguide section in such a manner that an intermediate space is defined therebetween which contains said liquid absorber material, and further comprising a layer of insulating material of a dielectric tightly covering said apertures so as to separate said interior of said waveguide section from said intermediate space.

8. A waveguide device as defined in claim 7 wherein said absorber material is water.

9. A waveguide device as defined in claim 7 wherein said layer of insulating material is a dielectric selected from the group consisting of thermoplastic, polytetrafluoroethylene and quartz.

10. A waveguide device as defined in claim 7 wherein said layer of insulating material covers said waveguide section along its entire length.

11. A waveguide device as defined in claim 7 wherein said surrounding means is a container having inlet means and outlet means, and further comprising a recooling unit for circulating and cooling said absorber material.

12. A waveguide device as defined in claim 1 wherein said absorbing means includes a solid absorber material.

13. A waveguide device as defined in claim 12 wherein said solid absorber material is silicon carbide.

14. A waveguide device as defined in claim 1 wherein each of said apertures extends along the direction of propagation of the wave with an inclination relative to said axis to allow a same amount of power to be coupled out through each of said apertures.

15. A waveguide absorber, comprising:

a waveguide section havng an interior defined by one closed axial end and a connecting flange at its other axial end; and absorbing means arranged externally along said waveguide section for absorbing a wave propagating in said waveguide section along a direction of progation, said waveguide section being provided with a plurality of apertures for coupling said absorbing means with said interior, said apertures being spaced successively along the direction of wave propagation and being of a shape and dimension so that the wave is allowed to penetrate said absorbing means and a same amount of power is coupled out through each of said apertures.

16. A waveguide attenuator, comprising:

a waveguide section having an interior and defining an axis, said waveguide section being provided with a connecting flange at each axial end thereof; and absorbing means arranged externally along said waveguide section for attenuating a wave propagating in said waveguide section in a direction of propagation along said axis, said waveguide section being provided with a plurality of apertures for coupling said absorbing means with said interior, said apertures being spaced successively along the direction of wave propagation and being of a shape and dimension so that the wave is allowed to penetrate said absorbing means and a same amount of power is coupled out through each of said apertures.

17. A waveguide device as defined in claim 5 wherein said apertures are spaced from each other with decreasing inclination for utilizing transverse currents of said wave to couple out a same amount of power through each of said apertures.

18. A waveguide device as defined in claim 5 wherein said apertures are spaced from each other with increasing inclination for utilizing longitudinal currents of said wave to couple out a same amount of power through each of said apertures.

* * * * *